United States Patent [19]

Liao

[11] Patent Number: 4,769,878

[45] Date of Patent: Sep. 13, 1988

[54] DEVICE FOR GRIPPING THE CLOTHES HANGERS

[76] Inventor: Ping-Hui Liao, 8 Fl., 103 An-Ho Rd., Taipei, Taiwan

[21] Appl. No.: 11,273

[22] Filed: Feb. 4, 1987

[51] Int. Cl.[4] ..... B65D 85/18

[52] U.S. Cl. ..... 24/535; 24/502; 206/279; 206/291; 211/124

[58] Field of Search ..... 24/494, 502, 503, 504, 24/515, 516, 514, 535, 536, 538, 541, 539, 241 PS; 269/254 R, 236; 211/123, 124, 113, 60.1; 206/279, 291, 289, 292, 290

[56] References Cited

U.S. PATENT DOCUMENTS

| | | | |
|---|---|---|---|
| 878,060 | 2/1908 | Hammond | 24/241 PS X |
| 1,814,900 | 7/1931 | Deppe | 24/241 PS X |
| 2,276,628 | 3/1942 | Quitter | 24/241 PS |
| 3,920,265 | 11/1975 | Nilsson | 24/241 PS X |
| 4,252,220 | 2/1981 | London et al: | 24/516 X |
| 4,618,058 | 10/1986 | Gregg et al. | 24/515 X |

*Primary Examiner*—Kenneth J. Dorner
*Assistant Examiner*—James R. Brittain
*Attorney, Agent, or Firm*—Ostrolenk, Faber, Gerb & Soffen

[57] ABSTRACT

A device for gripping clothes hangers comprising a C-shaped housing having an upper horizontal frame for connection to a suitcase. A handle is pivotally connected to the upper horizontal frame of the housing. The handle is latchable to a parallel lower horizontal frame of said housing; a torsion spring having two substantially perpendicular arms fixed in the inner upper corner of the housing. An elastomic C-shape seat includes a lower horizontal part that is fixed inside the lower horizontal frame of the housing. The upper horizontal part of the seat is capped with a rigid cap which is pivotally connected to said handle and to one arm of the torsion spring. The other arm of the torsion spring is sealed inside said housing by a plate which is connected to the vertical part of said housing. The upper horizontal part of the seat is pushed downward to grip the curved portions of the clothes hangers placed inside the seat as the handle is pressed and rotated downward. An element with two latches and a compression spring is inside the open end of said lower horizontal frame. A hook on the inner surface of the handle is engaged with the front latch of said element. The hook is released from said front wedge by pressing the rear latch of said element.

8 Claims, 2 Drawing Sheets

DEVICE FOR GRIPPING THE CLOTHES HANGERS

BACKGROUND OF THE INVENTION

The present invention relates to devices for gripping the clothes hangers and more particularly to devices suitable for installation inside luggages.

On business trips of present travellers always find the clothes packed within their luggages have too many wrinkles. Because the clothes hangers have long been used for keeping the clothes in good shape, two types of devices have been developed for directly holding the clothes hangers together with clothes in luggage. One of them is only suitable for holding a specially designed clothes hangers, and the other comprises a rigid C-shaped seat mounted inside a C-shaped housing, together with a handle pivotally connected to the upper horizontal frame of said housing, and a torsion spring mounted at the connection between said handle and said housing, wherein said handle can be rotatefd and connected to the lower horizontal frame of said housing by engaging a nipple on each side of said lower frame with receiving holes on said handle.

Because said C-shaped seat is firmly fixed inside the housing in the latter device, the curved portions of the clothes hangers placed inside the opening of said seat are not gripped and firmly held. Also, the handle only can be opened by applying a force to lift the handle itself.

SUMMARY OF THE INVENTION

It is an object of the present invention to provide a device for firmly gripping the curved portions of the conventional type clothes hangers.

It is another object of the present invention to provide an unique push button type device for gripping and releasing the clothes hangers.

In accomplishing these and other object this device for gripping clothes hangers comprises a C-shaped case body; a handle pivotally connected to the upper horizontal frame of said housing, which handle can be rotated toward the opening of said housing means for making or breaking the connection between said handle and the lower horizontal frame of said housing; a torsion spring having two substantially perpendicular arms, which is fixed in the inner upper corner of said housing; and a C-shaped seat comprising a lower horizontal part, an upper horizontal part, and a flexible vertical part, said lower horizontal part being fixed inside the lower horizontal frame of said housing, and said upper horizontal part being capped with a rigid cap front end (near the opening of said seat) of said cap is pivotally connected to said handle with the connected position being below said pivotal connection between said handle and said upper horizontal frame, and the rear end of said cap having a ring which is hooked by one arm of said torsion spring; and the other arm of said torsion spring being sealed inside the vertical frame of said case body by a plate which is connected to the vertical part of said housing and which forms the outside wall of said housing, whereby the upper horizontal part of said seat is pushed downward to firmly grip the curved portions of the clothes hangers placed inside the opening of said seat as the handle is pressed and rotated dowmward.

The devices mentioned above are installed along the top of upper horizontal frame of said housing, and clothes hangers are hung in the opening of said C-shape seat by their curved portions. Because the location of the pivotal connection between said handle and said housing is higher than the connection between said rigid cap and said handle, a lever mechanism is formed as a force is applied at the lower end of said handle. Consequently, the rigid cap together with said upper horizontal part is pushed downward with said flexible vertical part of said seat and said torsion spring being twisted. Also because of the deformation energy stored by said flexible vertical part and said torsion spring, the handle is automatically pushed upward and maintained in an open position as the handle is released. There is an extra guide rail on the inner surface of said upper horizontal frame and above the rigid cap in order to assure the rigid cap moving downward.

The further inprovement provided by the present invention relates to an unique push button type releasing device for said means which comprises a hook on the inner surface of said handle, an aperture at the open end of the lower horizontal frame of said housing, a latch comprising an element with two latch members and a compression spring, said element which is placed inside the lower horizontal frame with said two latch members extending downward from said aperture, and said compression spring which is on the top of said element and confined in a compartment formed by said seat and said case housing. The hook is thereby engaged with the front latch member (near the opening end of said case body) of said element, and said hook is released from said front latch by pressing the rear latch of said element.

The objects, features, and advantages of the present invention are readily apparent from the following detailed description of the preferred embodiments when taken in connection with accompanying drawings.

DESCRIPTION OF THE PREFERRED EMBODIMENTS

Figure 1:
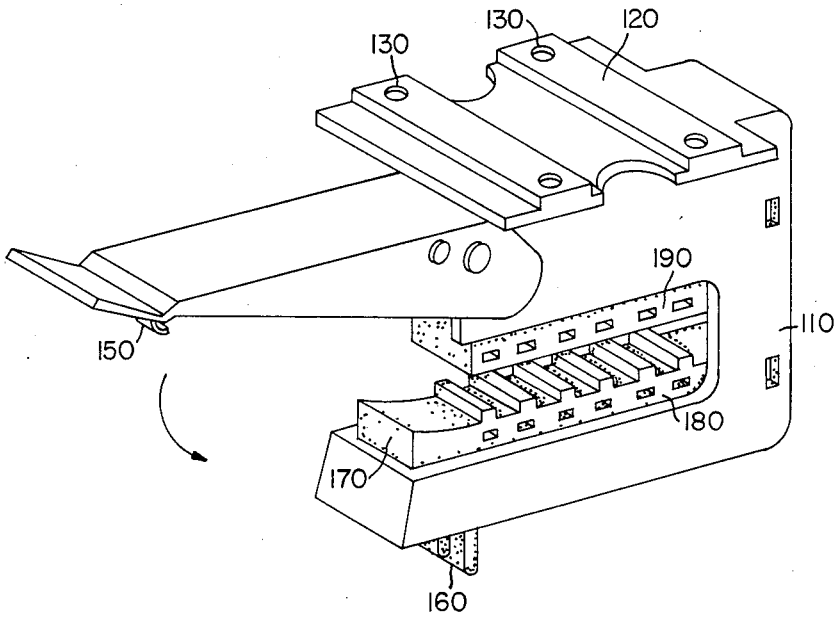
FIG. 1 is a perspective view of a device for gripping clothes hangers that is constructed in accordance with the present invention.
Figure 4:
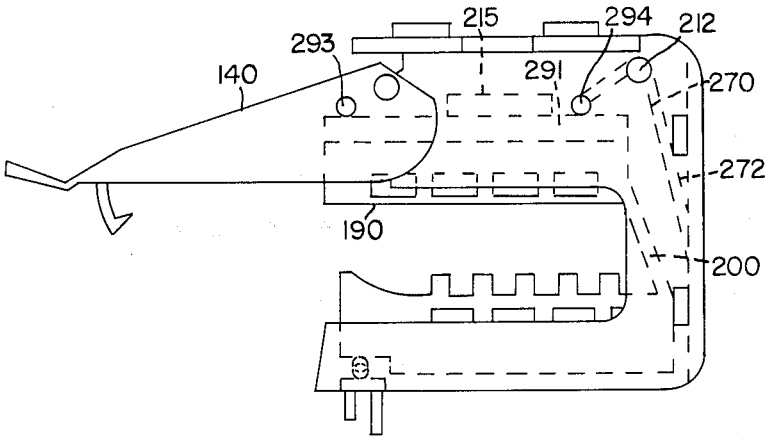
FIG. 4 is a side view of the device of FIGS. 1 and 2.
Figures 2, 3:
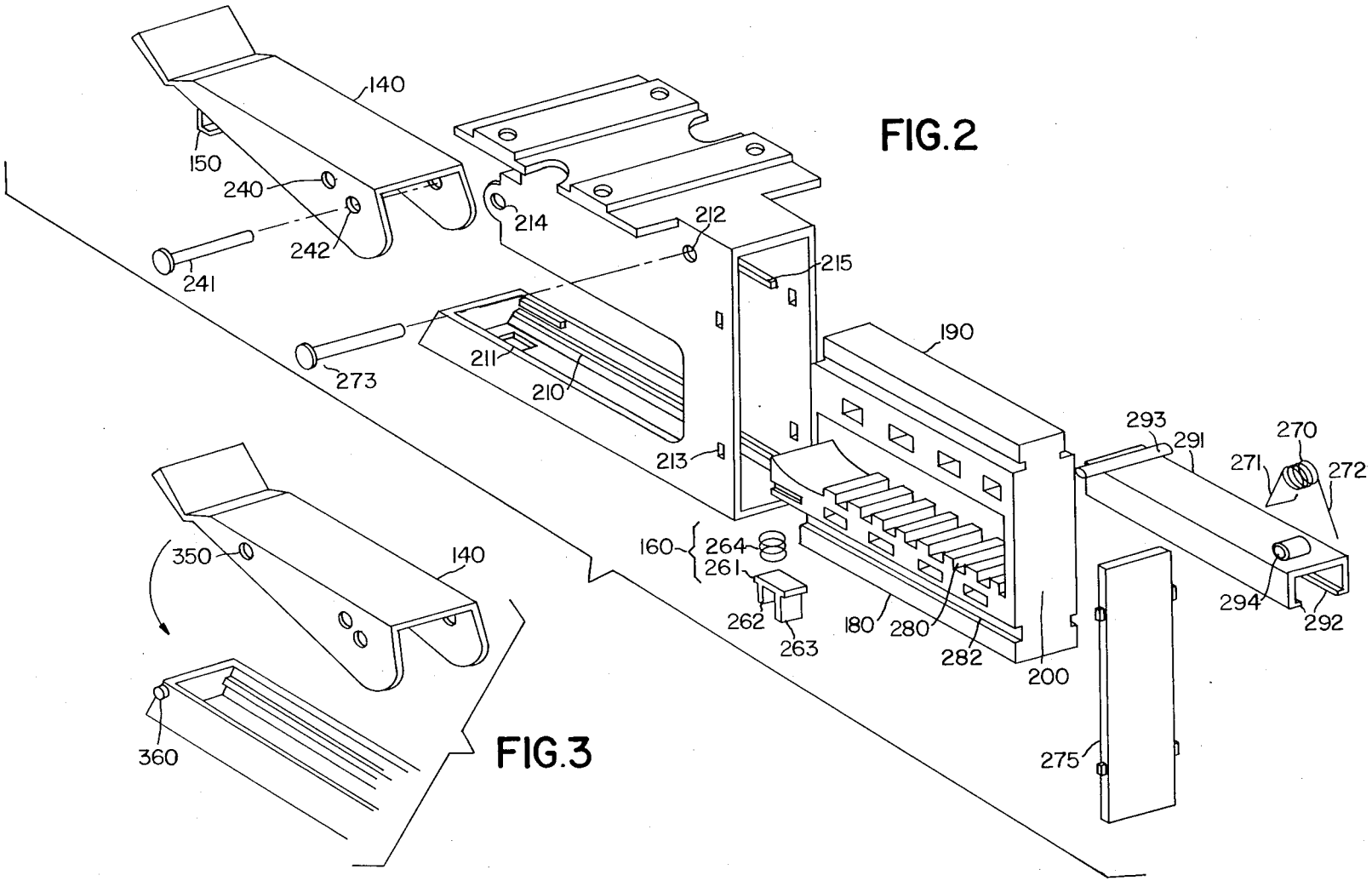
FIG. 2 is an exploded perspective view that illustrates the construction of a device for gripping the clothes hangers that is constructed in accordance with the present invention.
FIG. 3 is an exploded perspective view that illustrates the construction of a conventional mean for engaging the handle with the case body of device for gripping the clothes hangers that is constructed in accordance with the prensent invention.

Referring to FIGS. 1 and 2 of the drawings, the device of the present invention for gripping the clothes hangers constructed in accordance with the present invention includes a substantially C-shaped case body 110 housing a over size top plate 120 which has four apertures 130 to permit the installation of said device. A handle 140 housing a hook 150 on the inner surface is pivotally connected to the open end of the upper horizontal frame of said case body to permit said handle 140 to rotate counterclockwise and said hook 150 to engage with detent 262 of latch 160 by the application of a manual force at the lower end of said handle. In using the term "upper horizontal frame", the portion of the frame referred to is that which carries the top plate 120.

An elastomer-made substantially C-shaped seat 170 housing an upper horizontal part 190 parallel to and adjacent the upper horizontal frame of the casing, a lower horizontal part 180 parallel to and spaced from the part 190, and a flexible vertical part 200 normal to horizontal part 190 is mounted inside said case body 110. The top surface of said lower horizontal part 180 has a series of square teeth 280, and the curved portions of the clothes hangers are hanged between the teeth 280. There are a plurality of transverse through openings in said upper horizontal part 190 and lower horizontal part 180 to increase their deformation ability. The lower horizontal part 180 having a discontinuous channel 282 on each side surface is fixed inside the lower horizontal frame of said case body by coupling said channel 282 with a slide rail 210 on each inner side surface of said case body.

The upper horizontal part 190 having a T-shaped rail on the top and is capped with a rigid cap 291 by engaging the longitudinal grooves of said T-shape rail 190 with the associated webs 292 on said cap 291. The rigid cap 291 has a pin 293 in the front and a ring 294 in the rear of the top surface. The pin 293 is received by a pair of apertures 240 on the handle 140 and the ring 294 is hooked by one arm 271 of a torsion spring 270.

The torsion spring 270 which has two arms separated by 80° is fixed in the inner upper corner of the case body by inserting a pin 273 through hole 212 on each side of said case body and the axis hole of the torsional spring. The end of arm 271 of the torsion spring 270 is bent into a shape of hook to engage with the ring 294 of the rigid cap. And the other arm 272 of the torsion spring, which is straight, is sealed inside the vertical frame of said case body by an end plate 275 which is connected to the vertical frame of said case body by the receiving slots 213 in opposite said case body.

The handle 140 is pivotally connected to the open end of the upper horizontal frame of said case body by utilizing a pin 241 engaged with a receiving hole 242 on each side of the handle and a receiving hole 214 on each side of said case body. Because the hole 242 is higher than hole 240, a lever mechanism is formed as a force is applied at the lower end of said handle. Consequently, the rigid cap 291 together with said upper horizontal part 190 is pushed downward with said flexible vertical part 200 of said seat and said torsion spring 270 is twisted. An extra guide rail 215 on the inner side surface of said upper horizontal frame is located above the rigid cap 291 and in contact with the rigid cap when the handle is maintained at the open position, in order to assure that the rigid cap moves downward as the handle is pressed and rotated downward.

A latch 160, which controls the engagement between said hook 150 and the lower horizontal frame of said case body, comprises an element 261 housing two detent members 262 and 263, and a compression spring 264. The element 261 is placed inside said lower horizontal frame with the two detect members 262 and 263 extending downward from an aperture 211 of said lower horizontal frame, and the compressional spring 264 is on the top of said element 261 and confined in a compartment formed by said seat and said case body. The detent hook 150 is engaged with the front detent 262, and said hook is released from said front detent by pressing the rear detent 263 of said element 261. Because of the deformation energy stored by said flexible vertical part 200 and said torsion spring 270, the handle 140 is automatically pushed upward and maintained in open position as the hook 150 is released from said latch 160.

FIG. 3 illustrates an alternative means for engaging the handle 140 with the case body, wherein a nipple 360 on each side surface of the open end of the lower horizontal frame is received by a hole 350 on each side of the handle 140. The handle 140 can be opened or closed by the application of a manual force at the lower end of the handle.

What is claimed is:

1. A device for gripping and positioning clothes hangers in a piece of luggage, or the like, comprising:

a C-shaped housing; the housing having an upper horizontal frame securable to the interior of a piece of luggage, a lower horizontal frame extending beneath and spaced from the upper horizontal frame and a vertical frame rigidly connecting the horizontal frames, the horizontal frames extending away from the vertical frame defining an opening into the housing at the ends of the horizontal frames;

a handle pivotally connected to the upper horizontal frame, the handle being rotatable past the opening of the housing to connect the upper and the lower horizontal frames;

means for disconnectably connecting the handle to the lower horizontal frame;

a torsion spring having two substantially perpendicular arms;

a substantially C-shaped seat, inside the housing; the seat having an opening, and the opening of the seat and the opening of the housing being oriented to open in the same direction; the seat comprising a lower horizontal part, an upper horizontal part above and spaced from the lower horizontal part, and a flexible vertical part connecting the horizontal parts; the lower horizontal part being fixed inside the lower horizontal frame of the housing;

a rigid cap over the upper horizontal part of the seat, the cap having a front end toward the opening of the seat, and the front end of the cap being pivotally connected to the handle at a point of connection below the pivotal connection between the handle and the upper horizontal frame; the cap having an opposite rear end and the rear end of the cap having a ring, the ring being hooked by one arm of the torsion spring; and the other arm of the torsion spring being connected to the vertical frame of the housing;

a plate connected to the vertical frame of the housing and forming an the outside vertical wall of the housing and the other arm of the spring being covered by the plate;

whereby the upper horizontal part of the seat is pushed downward to firmly grip the clothes hangers placed inside the opening of the seat as the handle is rotated downward toward the lower horizontal frame.

2. A device for gripping clothes hangers according to claim 1, comprising:

a. the handle having an inner surface, and a hook on the inner surface of said handle;

b. an aperture at the opening of the housing on the lower horizontal frame of the housing;

c. the means for disconnectably connecting comprising a latch comprising an element with two latch members, the element being located inside said lower horizontal frame with the two latch members extending downward from the aperture, and a compression spring located on top of the element and confined in a compartment formed by the seat and the housing;

the hook being engageable with the front one of the latch members, the rear one of the latch members being connected with the front latch member such that the hook is released from the front latch member by pressing the rear latch member.

3. A device for gripping clothes hangers according to claim 1, wherein the means for connecting comprises a nipple on each side surface of the lower horizontal frame, and a receiving hole for a respective nipple on each side of the handle.

4. A device for gripping clothes hangers according to claim 1, further comprising means for fixing the lower horizontal part of the seat inside the lower horizontal frame of the housing, the means for fixing comprising a channel on each side surface of the lower horizontal part and a slide rail on each inner side surface of said lower horizontal frame coupled to a respective channel.

5. A device for gripping clothes hangers according to claim 1, having a T-shaped rail on the upper horizontal part of the seat and webs extending from the cap and wherein the upper horizontal part of the seat includes a T-shape rail on the top of the upper horizontal part, and a rigid cap over the upper horizontal part of the seat and including associated webs on the rigid cap for receiving the T-shape rail.

6. A device for gripping the clothes hangers according to claim 1, wherein said one arm of the torsional spring is bent into a shape of hook.

7. A device for gripping the clothes hangers according to claim 1, wherein said upper horizontal frame of said housing further contains an additional guide rail on the inner side surface, and the additional guide rail is located above said rigid cap and in contact with said rigid cap when the handle is maintained at the open position.

8. A device for gripping and positioning clothes hangers in a piece of luggage, or the like, comprising:

a C-shaped housing; the housing having an upper horizontal frame, a lower horizontal frame extending beneath and spaced from the upper horizontal frame, and a vertical frame rigidly connecting the horizontal frames, the horizontal frames extending away from the vertical frame defining an opening into the housing at the ends of the horizontal frames;

a handle pivotally connected to the upper horizontal frame, the handle being rotatable past the opening of the housing to connect the upper and the lower horizontal frames;

means for disconnectably connecting the handle to the lower horizontal frame;

a substantially C-shaped seat inside the housing; the seat having an opening, and the opening of the seat and the opening of the housing being oriented to open in the same direction; the seat comprising a lower horizontal seat part, an upper horizontal seat part above and spaced from the lower horizontal seat part, and a flexible vertical seat part connecting the horizontal seat parts; the lower horizontal seat part being fixed inside the lower horizontal frame of the housing;

a rigid cap over the upper horizontal part of the seat, the cap having a front end toward the opening of the seat, and the front end of the cap being pivotally connected to the handle at a point of connection below the pivotal connection between the handle and the upper horizontal frame; the cap having an opposite rear end; a spring supported by the housing, the spring being connected to the rear end of the cap for urging the cap and the upper horizontal part of the seat away from the lower horizontal part of the seat;

whereby the upper horizontal part of the seat is pushed downward against the bias of the spring to firmly grip clothes hangers placed inside of the opening of the seat as the handle is rotated downward toward the lower horizontal frame.

* * * * *